United States Patent [19]

Johnson

[11] 4,095,539

[45] Jun. 20, 1978

[54] NEEDLE THREAD WORK LIMB RETAINERS

[75] Inventor: Ralph E. Johnson, Convent Station, N.J.

[73] Assignee: The Singer Company, New York, N.Y.

[21] Appl. No.: 717,053

[22] Filed: Aug. 23, 1976

[51] Int. Cl.[2] ..... D05B 57/14

[52] U.S. Cl. ..... 112/184; 112/231

[58] Field of Search ..... 112/181, 157, 201, 228, 112/231, 184, 187, 182, 183, 185, 186, 197, 230, 229

[56] References Cited

U.S. PATENT DOCUMENTS

| | | | |
|---|---|---|---|
| 1,929,323 | 10/1933 | Maier | 112/199 |
| 2,696,794 | 12/1954 | Kirsch | 112/197 |
| 3,805,719 | 4/1974 | Thompson | 112/228 X |

FOREIGN PATENT DOCUMENTS

| | | | |
|---|---|---|---|
| 1,289,126 | 2/1962 | France | 112/198 |

*Primary Examiner*—Werner H. Schroeder

*Assistant Examiner*—Moshe I. Cohen

*Attorney, Agent, or Firm*—Robert E. Smith; Edward L. Bell; Julian Falk

[57] ABSTRACT

This disclosure relates to sewing machines and in particular to a means for reducing uneven and slack stitching due to frictional engagement between the work limb and the takeup limb of the needle thread which can cause pulling up of the work limb through the fabric between castoff of a loop from the loop taker and stitch setting. This undesirable effect is sometimes called "haloing". A work limb retainer is provided and is carried apart from the loop taker and thread carrying bobbin and is disposed for seizing the work limb of the needle thread substantially immediately after loop seizure by the loop taker, retaining of the work limb during the normal loop taker cycle, and discharging the work limb after the thread has completed its passage around the loop taker. The work limb is thereby prevented from frictionally engaging the take up limb during this cycle and thus eliminates the possibility of the take up limb pulling the work limb up to the fabric to cause a haloing effect.

7 Claims, 8 Drawing Figures

NEEDLE THREAD WORK LIMB RETAINERS

BACKGROUND OF THE INVENTION

During the formation of lockstitches which are formed by concatenating a needle thread around a bobbin thread, an undesirable effect is sometimes produced call haloing which has its results in producing uneven slack stitches particularly on the top side of the fabric as it is being sewn. It is believed that this effect is produced due to the frictional engagement of the work limb of the needle thread and the takeup limb between the casting off of the loop seized by the loop taker and the stitch setting operation. It is, of course, desirable in producing lockstitches that the stitches be relatively firmly and evenly set so as to firmly secure the plies of fabric being sewn without any undesirably slack thread appearing on the face of the fabric. In accordance with the present invention, this undesirable effect is substantially eliminated by providing a needle thread work limb retaining means which is disposed so as to seize the work limb of the needle thread substantially immediately after loop seizure by the beak of the loop taker. The work limb retainer means is positioned so as to keep the work limb separated from the take up limb of the needle thread during passage of the loop around the loop taker and is released therefrom after the thread loop has completed its passage about the loop taker. The take up limb may then be pulled up by the needle during its return stroke without any frictional engagement with the work limb to thereby set the stitch just formed without any excess thread from the work limb being pulled up through the fabric which might have caused a slack loop on the top side of the fabric. Thread detainers are known in the art for holding on to a thread loop after cast off for maintaining tension on the thread loop so as to prevent "pig tailing" which may be defined a twisting of the thread upon itself. This is a common defect in shuttles of the oscillating type and is not analogous to haloing. These thread detainers are disposed merely to hold on to the thread loop and do not act to separate the two limbs of the thread loop, namely the work limb and the take up limb, in order to prevent haloing. Further, such thread detainers are often mounted on the leading end of the usual thread guard or on the stationary bearing race frame in shuttle mechanisms.

As will be apparent from the following detailed description, a work limb thread retainer is provided which is supported apart from the loop taker and the bobbin in a position for substantially immediately seizing the work limb of the needle thread loop after it is seized by the beak of the loop taker. The work limb is retained by the retainer means during passage of the needle thread loop around the loop taker for concatenation with a thread from the bobbin case and is released after the thread loop has completed its passage about the loop taker. As mentioned above, the retainer serves to keep the work limb and the take up limb separated so that they do not come into frictional engagement during the cycle described above and thereby there is little, if any, chance of the take up limb frictionally engaging the work limb during the return stroke of the needle to thereby substantially prevent haloing. Other objects and advantages of the invention will be best understood when reading the following detailed description with the accompanying drawings.

DETAILED DESCRIPTION OF THE INVENTION

Figure 1:
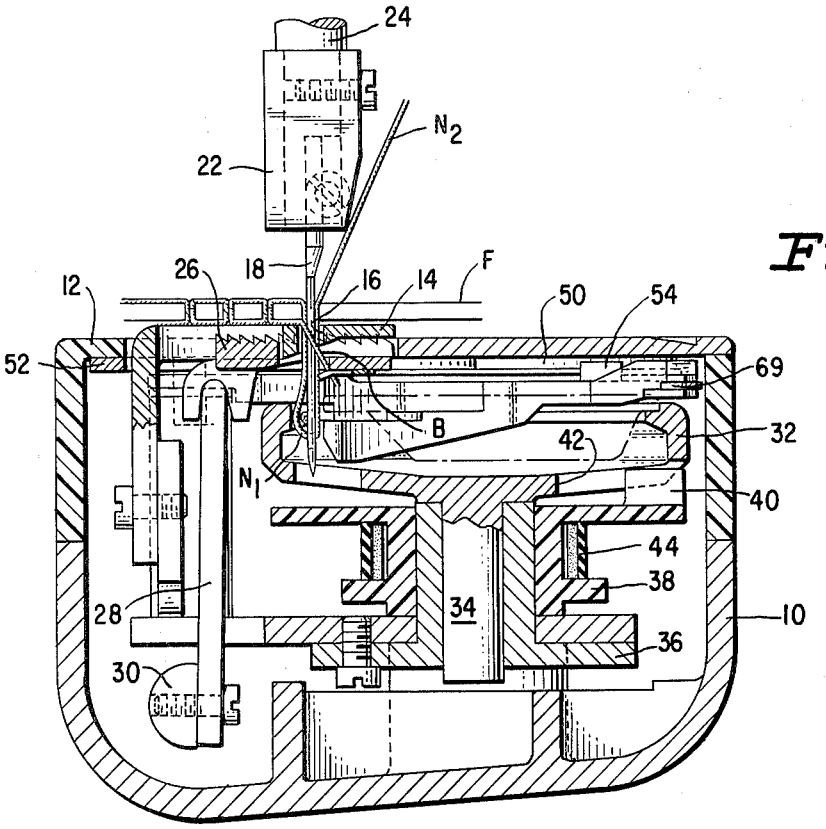
FIG. 1 is a cross-sectional view of the loop taker section of a lockstitch sewing machine with a portion of the needle mechanism shown therewith.

Referring to FIG. 1, a portion of a sewing machine is illustrated therein in cross section as including a substantially U-shaped bed portion 10 having a top cover plate 12 connected thereto. A throat plate member 14 is disposed in an opening in the top plate 12 and includes an aperture 16 for permitting the needle 18 to pass therethrough during its end wise reciprocating movement for penetrating a ply or plies of fabric F with a thread for concatenation with a thread from a bobbin to form lock stitches in a manner which will be more fully described hereinafter. The mechanism for reciprocating the needle in its end wise motion is well known in the art and, therefore, only a portion of the mechanism is illustrated herein as including a needle carrier 22 and a needle bar 24 which needle bar is typically connected to a crank mechanism driven by the main shaft of the sewing machine. A feed dog mechanism generally illustrated at 26 is also disposed in an opening in the top plate 12 for cooperating with the fabric F in order to feed the same across the surface of the top plate 12 for forming continuous stitches. The feed mechanism including the feed dog 26 may also be of a well known type for feeding a fabric through a sewing machine and for purposes of the present invention only a portion thereof is illustrated as including a rockarm 28 connected to a base portion of the feed dog 26 as by having one end thereof inserted in a slot in the base portion of the feed dog 26 and the other end thereof secured to a rock shaft 30 for imparting rocking motion or to an fro motion to the feed dog.

The sewing machine illustrated herein also includes a loop taker including a cup shaped portion 32 and a cylindrical shaft portion 34 depending therefrom which is disposed within a bearing 36 fixed to a portion of the machine frame. A rotary loop taker drive member 38 is disposed in surrounding engagement with the bearing member 36 and is rotatable relative thereto. The rotary drive member 38 includes a key or tooth portion 40 extending perpendicular to the top surface of the rotary drive member and is disposed in driving engagement with a slot 42 formed in the bottom portion of the cup shaped rotary loop taker. Suitable means are provided for driving the rotary drive member such as a timing belt 44 illustrated as disposed in driving engagement with an outer surface of the rotary drive member 38. The timing drive belt may be suitably connected to a source of power such as an electric motor or the like for driving the rotary loop taker. It will be understood, however, that other means may used for driving the rotary loop taker as for example, a gear drive taken from a rotary bed shaft as is common in the sewing machine art. As is also well known in the sewing machine art, the rotary loop taker may be driven in timed relationship with the reciprocating motion of the needle 18 so that a beak portion 46 formed on the loop taker for seizing a loop of thread from the needle near or substantially near its lower most penetrating point will be in proper position for engaging the loop at the proper time.

Figure 2:
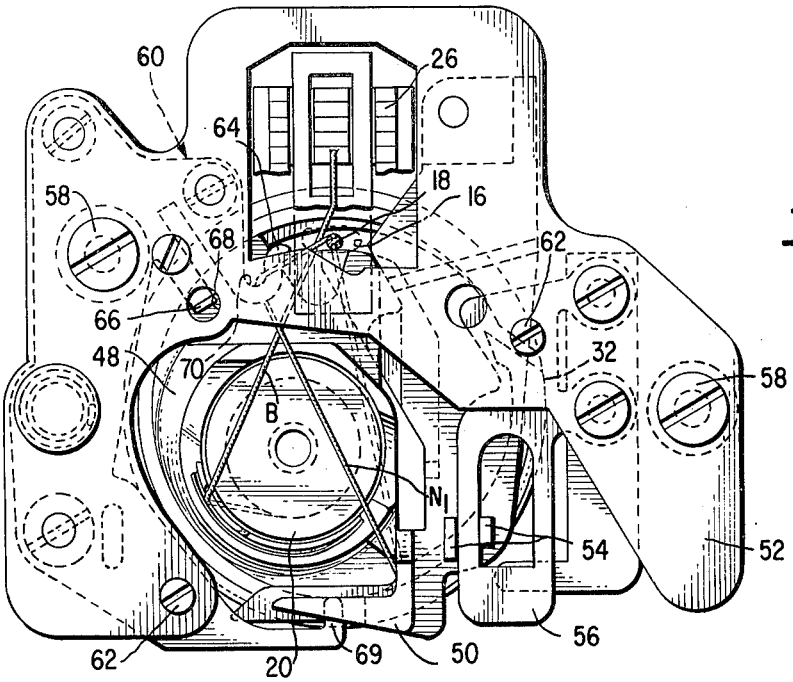
FIG. 2 is a top plan view of the loop taker section shown in FIG. 1.

As stated above, the rotary loop taker 32 is cup shaped and is so formed such that the rotary loop taker can carry a bobbin 20 within said cup shaped portion which is supported in a bobbin case 48. During operation of the machine, the bobbin and its bobbin case are held stationary during relative rotary movement of the rotary loop taker. In order to retain the bobbin and its bobbin case in a stationary condition during movement of the rotary loop taker, a bobbin case retainer member 50 is pivotably carried by a support plate 52 and includes a retaining portion which bears against a portion of the bobbin case for holding the same in a relatively fixed position when the retainer member is pivoted into engagement with the bobbin case. The bobbin case retainer member 50 is also provided with a pair of spaced lugs 54 for engagement with a spring retainer member 56 as illustrated in FIG. 2. In order to release the bobbin case retainer member, the spring member 56 may be lifted such that they one leg thereof will be disengaged from between the lugs 54 on the bobbin case retainer member and the bobbin case retainer member may then be pivoted away from the bobbin case 48 and out of engagement therewith in order to permit removal of the bobbin and its case. As also shown in FIG. 2, the support plate 52 is provided with appropriate apertures therein as for example for the feed dog 26, throat plate 14 and the bobbin 20 in its case 48 in order to permit these elements to properly function. Also, the support plate 52 is supported with the top plate 12 of the bed portion as by screws 58 when the mechanism is in the assembled condition.

Figure 5A:
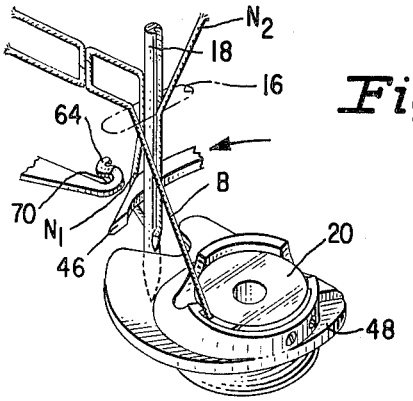
FIGS. 5*a* – 5*d* are diagramatic representations of a cycle of lock stitch formation illustrating the use of the mechanism of the present invention to eliminate haloing.

Very briefly referring to FIGS. 5*a* through 5*d*, during penetration of the needle 18 through the fabric F with the needle thread, when the needle is substantially at its lower most position, a loop of thread is thrown out away from the needle which is seized by the beak portion 46 of the rotary loop taker 32 as shown in FIG. 5*a*. During further rotation of the rotary loop taker 32, the loop of thread is carried around the bobbin 20 and its case 48 and also around a bobbin thread B to a position where the loop will be cast off from the rotary loop taker and will be concatenated with the bobbin thread. During the return stroke of the needle, the needle loop will be pulled back up through the fabric to set the stitch with the bobbin thread securely locked therewith. Such stitch formation is well known in the art as lock stitch. It has been found that sometimes when forming such lockstitches, in particular during zig-zag stitching wherein the lateral position of the needle changes from penetration to penetration and more particularly when the zig-zag stitching is made with relatively wide widths, a defect in the stitching occurs which may be termed haloing. Haloing may be described as a looseness or undesirable amount of slack in the work limb of the needle loop after the stitch has been set. Of course, it is desirable to have the stitches relatively firmly set so that there is no loose or slack thread to give an even and neat appearness to the stitching and the plies of fabric will be firmly secured together.

Figure 4:
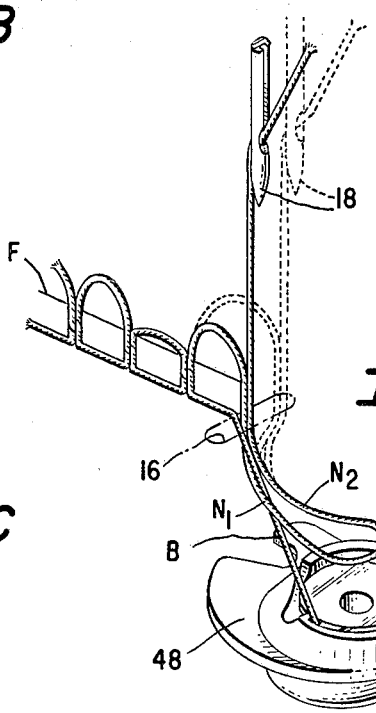
FIG. 4 is a diagramatic representation of the production of a haloing effect.

Referring to FIG. 4, an example of what is believed to be at least one cause of the formation of haloing is illustrated therein. In the illustration of FIG. 4, the needle loop is in the position of having been cast off by the rotary loop taker and the slack therein is being taken up by the needle and takeup mechanism of the sewing machine during the return stroke of the needle. During such time, the work limb $N_1$ and the take up limb $N_2$ are disposed in a relationship such that they are in frictional engagement with one another. As the take up limb $N_2$ is withdrawn up through the fabric, due to the frictional engagement between the limbs $N_1$ and $N_2$, the work limb $N_1$ may be dragged along with the take up limb $N_2$ such that a slack condition or a loop will form on the top side of the fabric F. As mentioned above, there is more likelihood of this condition occuring during zig-zag stitching wherein wide bight widths are used in that there is more thread required for the formation of such type stitches and, thus, more thread available to form a slack loop. As shown further in FIG. 4, some of the loops formed from the needle thread may have such a slack appearance and others may be relatively properly set so as to give an uneven and loose appearance to the stitching. It is the purpose of the present invention to overcome this type of defect in stitching.

Figure 3:
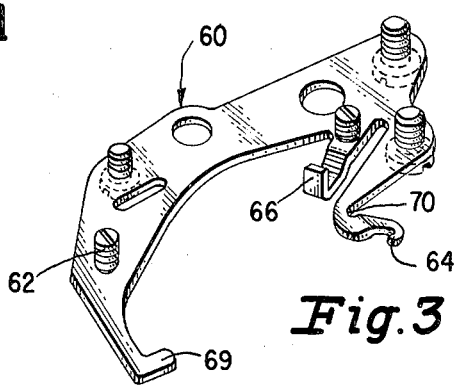
FIG. 3 is a perspective view of the work limb retainer mechanism.

In order to carry out the purpose of the invention, means are provided for physically separating the needle thread work limb and take up limbs during concatenation of the needle thread with the bobbin thread at least up until the time the thread has completed its passage around the bobbin case. Referring again to the drawings, as shown in FIGS. 2 and 3 in particular, a work limb retainer plate 60 is secured to the support plate 52 by screws 62 or the like and is provided with a work limb retainer finger member 64 at one end thereof. A finger like projection 66 is disposed in a vertically upward projecting relationship to the plate 60 and is positioned for seating within an aperture 68 and the support plate 52 and serves to help position the finger 64 for engaging a limb of the needle thread. As seen in FIG. 3, the retainer plate 60 is substantially C-shaped and when in position substantially surrounds one portion of the loop taker and is further provided with a finger like projection 69 which engages with the bobbin case retainer as illustrated in FIG. 2. It should be understood, however, that the invention is not restricted to the shape of the retainer plate 60 and said plate may take some other shape or form which will provide a proper positioning of the work limb retainer finger 64.

Figure 5B:
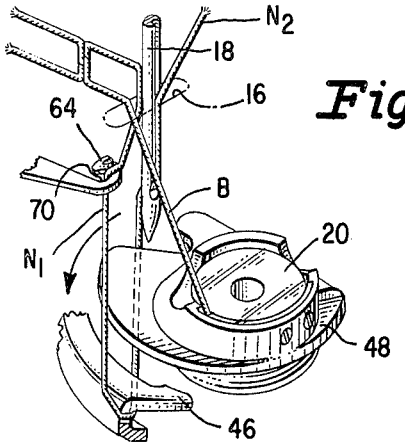
Figure 5C:
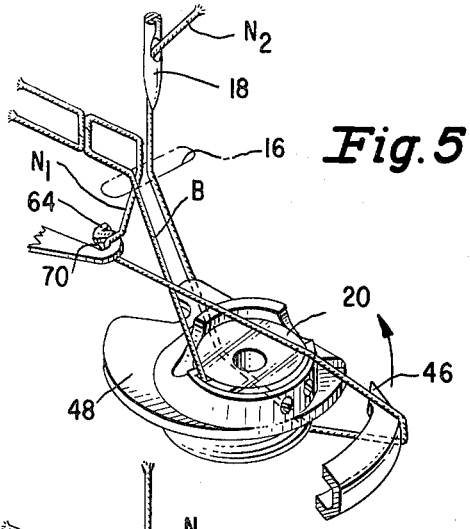
Figure 5D:
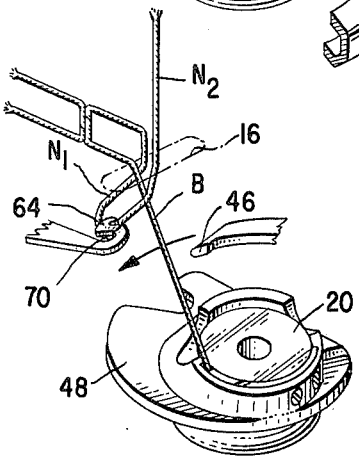

With further reference to FIG. 2 and FIGS. 5*a* and 5*d*, it will be seen that the plate 60 is supported with plate 52 such that the work limb retainer finger is supported so that its end will be disposed in the region of needle penetration and downstream with respect to the direction of rotary loop taker rotation. More specifically, the finger portion 64 is disposed such that substantially immediately after a loop is seized by the beak portion 46 of the rotary loop taker, it will engage the work limb $N_1$ of the new loop and is shaped such that the work limb $N_1$ will drape over the finger to an indented portion 70 thereof for retaining the work limb $N_1$ during the passage of the thread loop around the bobbin case 48 for concatenation with the bobbin thread B. Therefore, as seen in FIG. 5*a*, the work limb retainer finger is positioned for engagement with the work limb $N_1$ as the loop taker beak 46 is engaging the thread loop and as seen in FIG. 5*b*, as the beak portion continues to rotate with the rotary loop taker, the work limb $N_1$ is retained by the retaining finger 64 in the portion 70 thereof. In FIG. 5*c*, the thread loop is shown as having past substantially entirely around the bobbin case just prior to castoff of the loop from the beak 46 and there will be seen that the work limb $N_1$ and the take up limb $N_2$ are maintained in substantial separation from one another so that there is no frictional engagement therebetween. In FIG. 5*d*, it will be seen that the thread loop has been cast off from the beak and the loop is being taken up during the return stroke of the needle. As the needle is returning to its up position, the thread loop will be withdrawn from the work retainer finger 64 so that the loop may be properly set in the fabric to form even stitches without slack due to haloing. As seen in FIG. 5*d*, even at such time when the thread loop is just about to leave the work retainer finger 64, the work limb $N_1$ and the take up limb $N_2$ are still maintained in a state of substantial separation from one another. Therefore, there is little, if any, chance of the work limb being wrapped around the take up limb or in other words, the two limbs of the thread loop will have little opportunity to come into frictional engagement with one another so that as the take up limb is pulled up through the fabric it will not draw with it the work limb to bring about the effect defined herein as haloing.

It will be seen from the above detailed decription that a novel and improved mechanism is provided which is relatively simple in structure and relatively inexpensive to manufacture for preventing a defect in stitching called haloing. The retainer mechanism of the invention may be supported in a manner which has little effect on the working mechanism of the sewing machine such as the loop taker, the bobbin or the like and does not require any relatively complicated support structure or substantial modification to the support structure of the sewing machine. It will also be apparent to those skilled in the art that various changes and modifications may be made in the structure of the invention without departing from the spirit and scope thereof as defined in the appended claims.

Having thus set forth the nature of the invention, what we heretofore claim is:

1. In a sewing machine having a reciprocating thread carrying needle, a work supporting plate carried by said sewing machine for supporting work during penetration thereof by said needle, a loop taker supported under said work supporting plate, a thread carrying bobbin, said loop taker being operative for seizing a loop of thread extending from said needle to said work and for carrying the loop of thread around said bobbin for concatenating the needle thread with the bobbin thread to form a lockstitch, and means carried apart from said loop taker and said bobbin for positively separating the work limb of the loop of needle thread seized by said loop taker from the needle limb at least during passage of the seized loop of needle thread around said bobbin.

2. In a sewing machine as recited in claim 1 wherein said means carried apart from said loop taker and said bobbin comprises a retaining finger disposed adjacent to the path traversed by said needle during reciprocation thereof and in the path of a limb of the loop of thread extending from said needle and carried by said loop taker substantially immediately after seizure thereof by said loop taker.

3. In a sewing machine as recited in claim 2 wherein said retaining finger is supported under said work supporting plate.

4. In a sewing machine having a reciprocating thread-carrying needle, a work supporting plate for supporting work thereon and including aperture means for permitting the needle to pass through the work to a position below said work supporting plate, a rotary loop taker supported under said work supporting plate and having a thread-carrying bobbin supported therein, said rotary loop taker being operative for seizing a loop of thread extending from said needle to said work and for carrying the loop of thread around said bobbin to concatenate said needle thread with a thread from the bobbin thereby forming a lockstitch, and needle thread retaining means comprising a needle thread retaining finger supported on the loop taker side of said work supporting plate with said needle thread retaining finger being formed and disposed for receiving the work limb of the loop of thread from said needle substantially immediately after seizure of the loop of thread by said loop taker from said needle such that said work limb of thread from said loop of thread from said needle and the needle limb of thread from said loop of thread are kept apart from one another during passage of the needle thread around said bobbin, whereby said needle limb is deterred from frictionally engaging said work limb during concatenation of said needle thread with said bobbin thread.

5. In a sewing machine as recited in claim 4, wherein said needle thread retaining finger has a hooked end portion with said hooked end portion being formed for engaging said work limb of the loop of thread seized by said rotary loop taker during passage of said rotary loop taker by said needle thread-retaining finger and for releasing the seized limb of thread from the finger, after said loop of thread has substantially completed passage around said bobbin.

6. In a sewing machine as recited in claim 4 wherein said needle thread retaining finger is supported with said work supporting plate.

7. In a sewing machine as recited in claim 4 wherein said needle thread retaining finger is supported adjacent said rotary loop taker and downstream of said needle with respect to the direction of rotation of said rotary loop taker.

* * * * *